United States Patent [19]

Mörz et al.

[11] Patent Number: 4,810,979

[45] Date of Patent: Mar. 7, 1989

[54] MICROWAVE JUNCTION CIRCULATOR

[75] Inventors: Günter Mörz, Ludwigsburg; Wolfgang Weiser; Sigmund Lenz, both of Aspach; Erich Pivit, Allmersbach i.T., all of Fed. Rep. of Germany

[73] Assignee: Ant Nachrichtentechnik GmbH, Backnang, Fed. Rep. of Germany

[21] Appl. No.: 103,727

[22] Filed: Oct. 2, 1987

[30] Foreign Application Priority Data

Oct. 4, 1986 [DE] Fed. Rep. of Germany ..... 3633908

[51] Int. Cl.[4] ..... H01P 1/39

[52] U.S. Cl. ..... 333/1.1; 333/24.1

[58] Field of Search ..... 333/1.1, 24.1, 24.2

[56] References Cited

U.S. PATENT DOCUMENTS

| | | | |
|---|---|---|---|
| 3,089,101 | 5/1963 | Chait et al. | 333/1.1 |
| 3,246,262 | 4/1966 | Wichert | 333/1.1 |
| 3,434,076 | 3/1964 | Johnson . | |
| 3,466,571 | 9/1969 | Jansen et al. . | |
| 3,662,291 | 5/1972 | Cotter . | |
| 4,122,418 | 10/1978 | Nagao | 333/1.1 X |
| 4,280,111 | 7/1981 | Forterre et al. | 333/1.1 |
| 4,605,915 | 8/1986 | Marshall et al. . | |

FOREIGN PATENT DOCUMENTS

| | | | |
|---|---|---|---|
| 1117183 | 11/1961 | Fed. Rep. of Germany . | |
| 1107198 | 8/1984 | U.S.S.R. | 333/1.1 |
| 781024 | 8/1957 | United Kingdom . | |
| 836440 | 6/1960 | United Kingdom . | |

OTHER PUBLICATIONS

F. Okada et al., "Design of a High-Power CW Y-Junction Waveguide Circulator", IEEE Transactions on Microwave Theory and Techniques, vol. MIT-26, No. 5 (May, 1978), pp. 364-369.

F. Okada et al., "High-Power Circulators for Industrial Processing Systems", IEEE Transactions on Magnetics, vol. MAG-17, No. 6 (Nov. 1981), pp. 2957-2960.

*Primary Examiner*—Paul Gensler

*Attorney, Agent, or Firm*—Spencer & Frank

[57] ABSTRACT

A junction circulator suitable for high power, high-frequency use has a microwave junction zone which is penetrated by a static magnetic field. Disposed in the microwave junction zone is a ferromagnetic resonator composed of different dielectric media, at least one of which has ferromagnetic characteristics. The interfaces between the various dielectric media form three-dimensional bodies which extend over the entire height of the junction zone and which have cross sections that do not change in the direction of the static magnetic field. These interfaces may be provided by parallel ferrite rods, or a ferrite body with parallel bores.

23 Claims, 2 Drawing Sheets

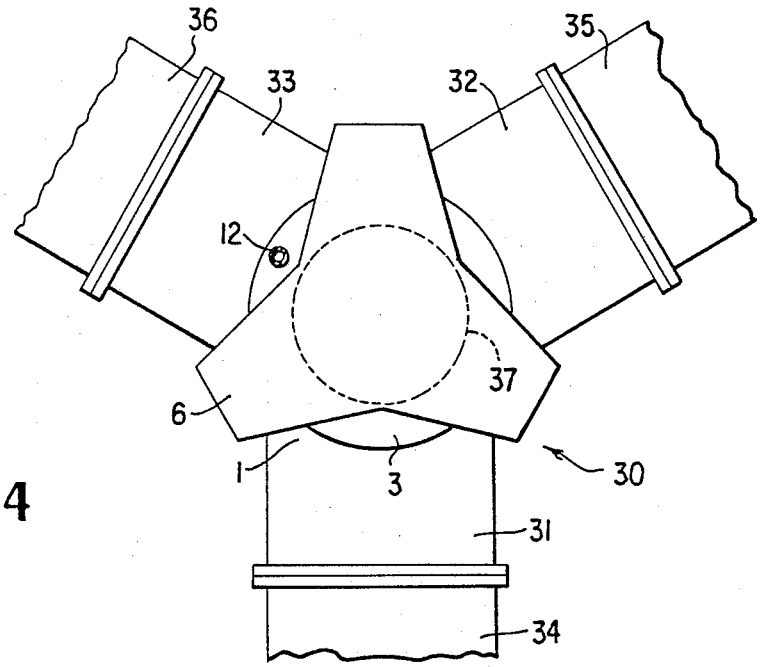
FIG.4
FIG. 5
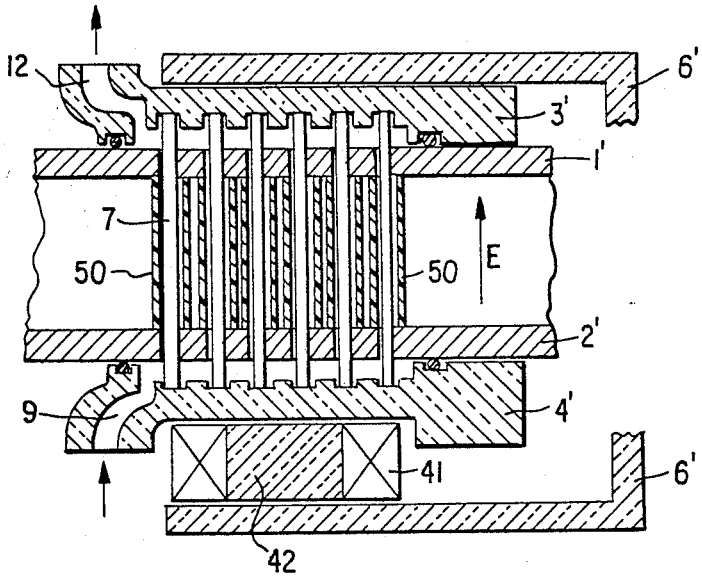
FIG.6
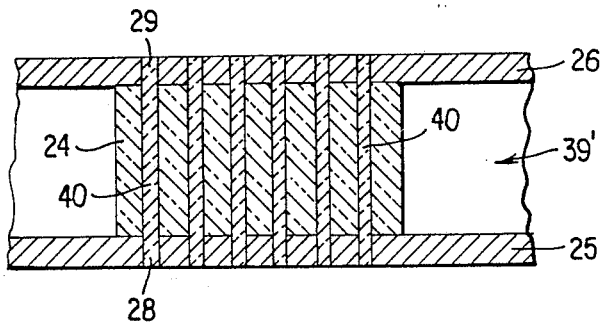

MICROWAVE JUNCTION CIRCULATOR

CROSS REFERENCE TO RELATED APPLICATIONS

The subject matter of this application is related to that of applicants' copending application entitled "High Power Junction Circulator having Ferrite Suspension at the Junction," Ser. No. 07/103,751, filed Oct. 2, 1987, the copending application being assigned to the assignee of the present application. The subject matter of the present application is also related to that of another copending application entitled "High Power Junction Circulator for High Frequencies," Ser. No. 07/103,728, filed Oct. 2, 1987, this co-pending application also being assigned to the assignee of the present application.

BACKGROUND OF THE INVENTION

The present invention relates to a microwave junction circulator including a microwave junction zone which is penetrated by a static magnetic field, with a ferromagnetic resonator composed of different dielectric media being disposed at the microwave junction zone, at least one of the different dielectric media having ferromagnetic characteristics.

A microwave circulator is a coupling device having a number of ports for connection to microwave transmission lines, such as waveguides or striplines. Microwave energy entering one port of the circulator is transferred to the next adjacent port in a predetermined direction. A threeport microwave circulator, for example, may be used to transfer energy from a klystron connected to the first port to a particle accelerator connected to the second port. Any microwave energy reflected back to the circulator by the particle accelerator then exits via the third port, so that the reflected energy is diverted from the klystron.

Circulators which have ferromagnetic resonators in their microwave junction zones and which were designed specifically for very high power, high-frequency applications are disclosed by Fumiaki Okada et al in the publications, IEEE Transactins on Microwave Theory and Techniques, Vol. MTT-26, No. 5, May, 1978, pages 364–369, and IEEE Transactions on Magnetics, Vol. MAG-17, No. 6, November, 1981, pages 2957–2960. In the circulators described in these publications, the ferrite structure is composed of a plurality of ferrite discs which are separated from one another by air gaps and which are arranged perpendicularly to the static magnetic field on metal carriers through which flows a coolant.

SUMMARY OF THE INVENTION

It is an object of the present invention to provide a circulator of the above-mentioned type which is suitable, in particular, for operation at very high power at high-frequencies.

This object can be attained, according to the present invention, by employing a ferromagnetic resonator having interfaces between the various dielectric media in the resonator, the interfaces forming three-dimensional bodies which extend over the entire height of the junction zone and which have cross sections that do not change in the direction of the static magnetic field. Parallel ferrite rods may be used, for example, or a ferrite body having parallel bores.

In the prior art high power circulators, the layering of ferromagnetic dielectric media in the junction zone perpendicularly to the static magnetic field is a very grave drawback with respect to power compatibility. In the customary H-plane junction circulator, the E field lines of the high frequency field lie parallel to the static magnetic field in the ferromagnetic resonator so that the interfaces of the ferrite layers intersect the E field perpendicularly, which results in very great field strength increases in the air gaps between the ferrite layers. Increasing the air gaps by raising the height of the resonator as a countermeasure against field strength increases is possible only conditionally since then the static magnetic field can no longer be generated with justifiable expenditures. In contrast thereto, the circulator according to the present invention has a resonator in its junction zone. The ferromagnetic dielectric medium of the resonator extends over the entire height of the waveguide junction zone and a non-ferromagnetic dielectric medium, which serves to dissipate heat, also extends over the full height of the junction zone. In this case, the static magnetic field as well as the electrical high frequency field are oriented tangentially to the interfaces between the ferromagnetic and the non-ferromagnetic dielectric media. Thus field strength increases are avoided in the ferromagnetic dielectric medium, so that the breakdown strength of the circulator becomes very high and the circulator is thus suitable for operation at extremely high power.

The resonator structure according to the invention additionally permits the dissipation of large quantities of heat, which protects the ferromagnetic dielectric medium against thermal destruction. This applies primarily for a finely structured configuration of the ferromagnetic dielectric medium because then a particularly good heat transfer to the heat dissipating dielectric medium is ensured. With the measures according to the invention it is possible to advantageously realize junction circulators in waveguide technology as well as in TEM waveguide technology (e.g. striplines).

BRIEF DESCRIPTION OF THE DRAWINGS

FIG. 4 is a top plan view of a waveguide circulator having the resonator structure of FIG. 1.

FIG. 5 is a cross-sectional view showing a modification of the embodiment of FIG. 1.

FIG. 6 is a cross-sectional view showing a modification of the embodiment of FIG. 3.

DESCRIPTION OF THE PREFERRED EMBODIMENTS

Figure 1:
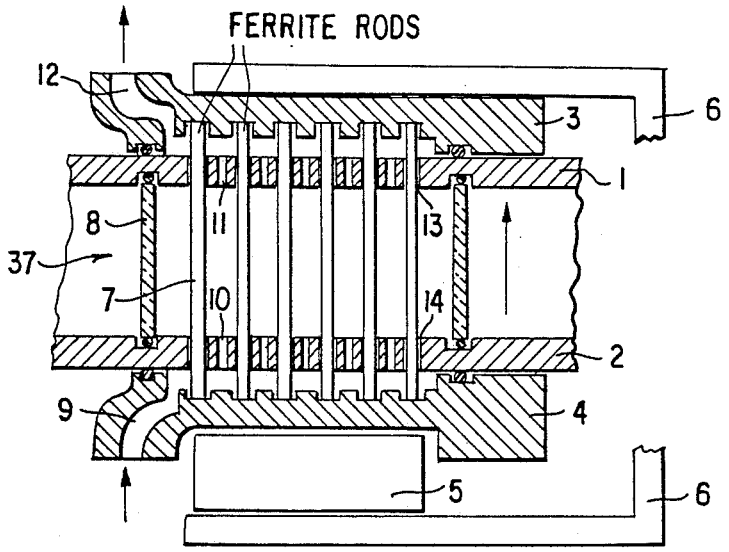
FIG. 1 is a cross-sectional view of a resonator structure in the junction zone of a waveguide circulator in accordance with an embodiment of the present invention.

With initial reference to FIG. 4, waveguide circulator 30 has three ports 31, 32, and 33 which are connected to microwave transmission lines such as hollow waveguides 34, 35, and 36. Ports 31–33 communicate with a microwave junction zone within circulator 30, and a resonator structure 37 is disposed in the microwave junction zone. FIG. 1 illustrates a sectional view of the resonator structure 37, together with two opposing waveguide walls 1 and 2 of the microwave junction zone and a magnet system which generates a static magnetic field to penetrate the junction zone.

The magnet system in the embodiment shown in FIG. 1 includes two pole pieces 3 and 4 disposed above and below the junction zone, respectively, a permanent magnet 5 and a yoke 6 forming the magnetic return outside the junction zone. One side of this yoke 6 rests on pole piece 3, the other side on permanent magnet 5.

The resonator structure 37 includes a ferromagnetic dielectric medium in the form of a plurality of ferrite rods 7 which extend between the two opposing waveguide walls 1 and 2 parallel to the E field of the circulator. In these ferrite rods 7, extending parallel to the E field from the one waveguide wall to the opposite wall without changes in cross section, the E field is just as large as in the non-ferromagnetic dielectric medium surrounding the ferrite rods 7. Thus, in contrast to conventional resonator structures having air gaps extending transversely to the E field, there are no field strength increases anywhere in the ferrite rods 7.

The result is that resonator structure 37 has an extremely high breakdown strength, so that circulator 30 is suitable for the transmission of very high power.

By subdividing the ferromagnetic dielectric medium into a plurality of individual, spaced rods 7, a large cooling surface is created, thus providing extremely favorable conditions for the dissipation of the heat generated in ferrite rods 7. With the aid of a coolant flowing around the ferrite rods 7, e.g. air or some other suitable gas or dielectric fluid, very large quantities of heat can be dissipated in a simple manner. For this purpose, all ferrite rods 7 are surrounded by a dielectric cylinder 8 which delimits the resonator 37 and which is sealed at the waveguide walls 1 and 2. In this dielectric cylinder 8, a liquid or gaseous coolant is introduced through an influx channel 9 in pole piece 4 and a plurality of holes 10 in waveguide wall 2 and is discharged through holes 11 in the opposite waveguide wall 1 and a discharge channel 12 in the other pole piece 3. On the exterior faces of waveguide walls 1 and 2, the two pole pieces 3 and 4 are sealed against the escape of coolant.

Passage holes 10 and 11 in waveguide walls 1 and 2 have such dimensions that they are impermeable to the high frequency field in the circulator.

Instead of the cooling device shown in FIG. 1, FIG. 5 illustrates an alternative wherein each individual ferrite rod 7 is accommodated in a small dielectric tube 50 and coolant is conducted through each tube 50 via openings in waveguide walls 1' and 2'. Although not illustrated in FIG. 5, tubes 50 are preferably sealed to waveguide walls 1' and 2' by O-rings.

The temperature gradient in the ferrite rods 7 is very small in the longitudinal as well as the transverse direction, so that mechanical destruction of the ferrite rods 7 due to thermal stresses need not be feared.

As shown in FIG. 1, ferrite rods 7 are brought through openings 13 and 14 in the two waveguide walls 1 and 2. These openings are impermeable to the high frequency field. This provides, on the one hand, a very simple mount for ferrite rods 7. On the other hand, the fact that ferrite rods 7 are brought through waveguide walls 1 and 2 up to pole pieces 3 and 4 causes the magnetic resistance of the magnetic circuit to be reduced in an advantageous manner. As a result, only a relatively small magnetic field strength needs to be generated, so that a relatively inexpensive magnet system can be used. The reduction of the magnetic resistance between the magnet system and the ferrite rods 7 has the additional advantage that the magnetization of the ferrite rods 7 can be increased to such an extent that the circulator is able to operate in above resonance mode at frequencies higher than about 2.5 GHz, the limit for above resonance operation up to now. In that case hardly any spin wave losses occur in the ferrite rods 7, which could otherwise produce non-linear effects.

Figure 2:
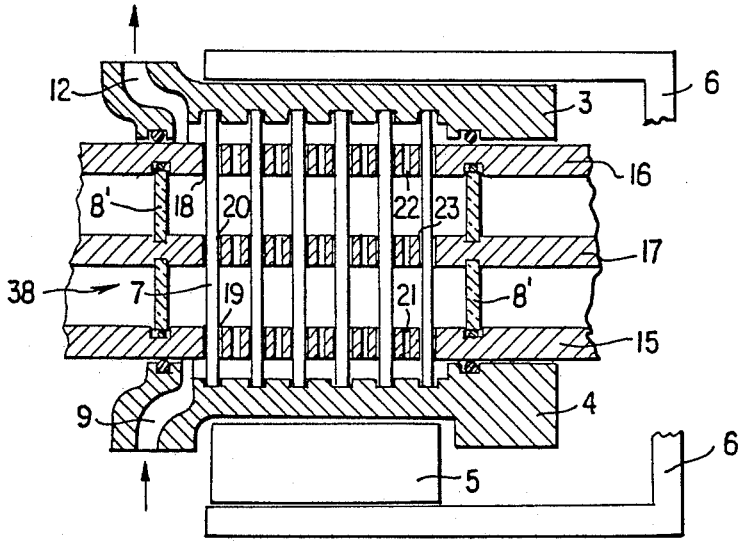
FIG. 2 is a cross-sectional view of a resonator structure in the junction zone of a circulator designed according to stripline technology in accordance with another embodiment of the invention.

FIG. 2 is a sectional view of the central portion of a planar junction circulator. This circulator has a symmetrical conductor structure composed of two planar outer conductors 15 and 16 and an inner conductor 17 disposed therebetween. Here again, as in the waveguide circulator (FIG. 1), the resonator structure 38 in the junction zone is composed of a plurality of spaced ferrite rods 7 oriented parallel to the E field in the junction zone. Ferrite rods 7 are brought through bores 18, 19 and 20 in outer conductors 15 and 16 and in inner conductor 17 so that ferrite rods 7 extend to pole pieces 3 and 4 of the magnet system. The magnet system corresponds to the one described above and is therefore marked with the same reference numerals as the system of FIG. 1.

In order for a liquid or gaseous coolant to be able to flow through the ferromagnetic resonator 38, openings 21, 22 and 23 are provided in outer conductors 15 and 16 and in inner conductor 17. Dielectric cylinders 8' surround the rods 7 and channel the flow of coolant.

Instead of cooling the ferromagnetic resonators in the circulator embodiments shown in FIGS. 1 and 2 by means of a liquid or gaseous dielectric medium, a solid dielectric medium (e.g. beryllium oxide ceramic) having good heat conductivity can be employed in which the ferrite rods 7 are then embedded.

Any desired cross-sectional shape (e.g. circular, square, star-shaped, hexagonal, or the like) can be selected for the ferrite rods 7 mentioned in the above-described embodiments. Care must only be taken that the cross section of the rods does not change in the direction of the static magnetic field.

Figure 3:
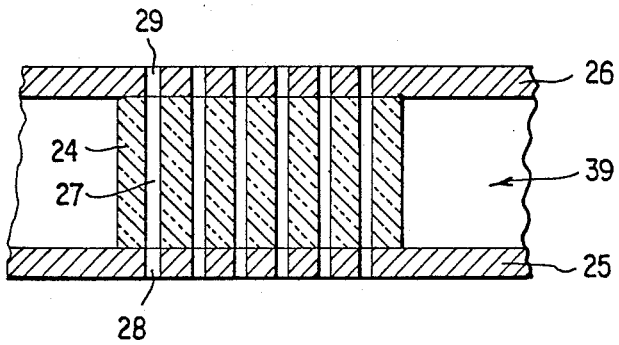
FIG. 3 is a cross-sectional view showing a further resonator structure for use in a waveguide circulator.

Another form of a ferromagnetic resonator structure is shown in FIG. 3. Here, the resonator structure 39 is composed of a ferrite body 24 which extends, for example in a waveguide circulator, from one waveguide wall 25 to the opposite wall 26. In this ferrite body 24, bores 27 extend parallel to the static magnetic field. These bores 27 are filled by a heat-dissipating, non-ferromagnetic gaseous or liquid dielectric medium. Bores 27 in ferrite body 24 communicate with bores 28 and 29 in waveguide walls 25 and 26 so that the gaseous or liquid dielectric medium is able to flow through the resonator structure 39. In the modification shown in FIG. 6, resonator structure 39' is not cooled by a fluid (gas or liquid) dielectric medium. Instead, heat-conducting rods 40 of beryllium oxide ceramic are disposed in the bores in ferrite body 24 and transfer heat to walls 25 and 26 via bores 28 and 29.

In the modification shown in FIG. 5 pole pieces 3' and 4' and magnetic yoke 6' are made of a ferrite material and, instead of a magnet 5 as in FIGS. 1 and 2, a coil 41 is wound on core 42. Current surges in the coil 41 then very quickly reorient the magnetic field and thus the direction of rotation of the circulator, which is the result of direct contact of ferrite rods 7 with pole pieces 3' and 4'. If the coil 41 is without current, the residual field strength in yoke 6', pole pieces 3 and 4, and ferrite rods 7 maintains the static magnetic field in the resonator structure. While the drawings illustrate this technique only for the modification shown in FIG. 5, the technique may also be employed in the embodiments shown in FIGS. 1 and 2.

An embodiment shown in FIG. 1 which for example operates at a frequency of 4 GHz is dimensioned as follows:

The distance between waveguide walls 1 and 2 in the junction zone is 15–20 mm. About 60 dielectric rods 7 having a square cross section (1 mm×1 mm) are positioned in an approximately circular pattern. And the spacing between neighboring rods is about 1 mm.

The embodiment shown in FIG. 3 operating at a frequency of 4 GHz has a distance between waveguide walls 25 and 26 of 15–20 mm as well as the waveguide walls 1 and 2 of the above described embodiment of FIG. 1. The ferromagnetic body 24 has the shape of a cylinder with a diameter of 20 mm and is provided with 60 bores 27. Each bore 27 has a diameter of 1.5 mm and the spacing between neighboring bores is about 2 mm.

The present disclosure relates to the subject matter disclosed in Federal Republic of Germany application, Ser. No. P 36 33 908.3, filed Oct. 4, 1986, the entire disclosure of which is incorporated herein by reference.

It will be understood that the above description of the present invention is susceptible to various modifications, changes and adaptations, and the same are intended to be comprehended within the meaning and range of equivalents of the appended claims.

What we claim is:

1. A junction circulator having a plurality of ports for connection to microwave transmission lines, comprising:

junction means, defining a microwave junction zone having a predetermined height, for communicating microwaves between the ports and the microwave junction zone;

means for generating a static magnetic field which penetrates the microwave junction zone; and a ferromagnetic resonator which is disposed entirely in the microwave junction zone and which does not extend into the ports, the ferromagnetic resonator including a plurality of different dielectric media with interfaces between the different media, at least one of the dielectric media having ferromagnetic characteristics, wherein the interfaces between the dielectric media form three-dimensional bodies which extend without interruption over the entire height of the microwave junction zone and which have cross sections that do not change in the direction of the static magnetic field.

2. The junction circulator of claim 1, wherein the at least one of the dielectric media having ferromagnetic characteristics comprises a plurality of rods that are oriented parallel to the static magnetic field and that are disposed in another dielectric medium.

3. The junction circulator of claim 2, wherein there is a high frequency field in the circulator when a port receives microwaves, wherein the transmission lines are waveguides, wherein the junction means comprises oppositely disposed waveguide walls having openings that are dimensioned to be impermeable to the high frequency field in the circulator, and wherein the rods extend through the openings.

4. The junction circulator of claim 2, wherein the transmission lines are striplines, wherein the junction means comprises a planar conductor structure for use with the striplines, the planar conductor structure having bores, and wherein the rods pass through the bores in the planar conductor structure.

5. The junction circulator of claim 2, further comprising a dielectric sleeve mounted in the junction means and surrounding the rods, and means for passing a fluid through the dielectric sleeve.

6. The junction circulator of claim 5, wherein the dielectric sleeve is cylindrical.

7. The junction circulator of claim 2, further comprising a plurality of dielectric cylinders, each dielectric cylinder being mounted in the junction means around a respective rod, and means for passing a fluid through the dielectric cylinders.

8. The junction circulator of claim 1, wherein the ferromagnetic resonator comprises a ferromagnetic body which fills the microwave junction zone and which has bores that extend parallel to the static magnetic field, the bores being filled with a different dielectric medium.

9. The junction circulator of claim 1, wherein one of the dielectric media is a ceramic having good heat conducting properties.

10. The junction circulator of claim 1, wherein one of the dielectric media is a liquid which flows through the ferromagnetic resonator to remove heat.

11. The junction circulator of claim 1, wherein one of the dielectric media is a gas which flows through the ferromagnetic resonator to remove heat.

12. The junction circulator of claim 1, wherein the means for generating a static magnetic field comprises means for reorienting the static magnetic field to change the direction of rotation in the circulator, the means for reorienting including a coil disposed outside the microwave junction zone.

13. The junction circulator of claim 12, wherein the means for generating a static magnetic field further comprises a ferromagnetic yoke disposed outside the microwave junction zone and forming a magnetic circuit with the at least one of the dielectric media having ferromagnetic characteristics, the coil being wound on the yoke, with the residual magnetic field in the yoke and the at least one of the dielectric media having ferromagnetic characteristics maintaining the static magnetic field when the coil carries no current.

14. The junction circulator of claim 1, wherein the number of said three-dimensional bodies is substantially greater than the number of ports of the circulator.

15. The junction circulator of claim 8, wherein the bores have axes that are parallel, the axes being spaced-apart.

16. The junction circulator of claim 15, wherein the bores are cylindrical and have the same diameter, and wherein the axes are spaced-apart by a distance greater than the bore diameter.

17. A junction circulator having a plurality of ports for connection to microwave transmission lines, comprising:

junction means, defining a microwave junction zone having a predetermined height, for communicating microwaves between the ports and the microwave junction zone;

means for generating a static magnetic field which penetrates the microwave junction zone; and a ferromagnetic resonator disposed in the microwave junction zone, the ferromagnetic resonator including a plurality of spaced-apart ferrite rods which extend parallel to one another over the entire height of the microwave junction zone and which have cross sections that do not change in the direction of the static magnetic field, the number of rods in the microwave junction zone being substantially greater than the number of ports.

18. The junction circulator of claim 17, wherein the rods are oriented parallel to the static magnetic field and are disposed in another dielectric medium.

19. The junction circulator of claim 18, wherein there is a high frequency field in the circulator when a port receives microwaves, wherein the tansmission lines are waveguides, wherein the junction means comprises oppositely disposed waveguide walls having openings that are dimensioned to be impermeable to the high frequency field in the circulator, and wherein the rods extend through the openings.

20. The junction circulator of claim 18, wherein the transmission lines are striplines, wherein the junction means comprises a planar conductor structure for use with the striplines, the planar conductor structure having bores, and wherein the rods pass through the bores in the planar conductor structure.

21. A junction circulator having a plurality of ports for connection to microwave transmission lines, comprising:

junction means, defining a microwave junction zone having a predetermined height, for communicating microwaves between the ports and the microwave junction zone;

means for generating a static magnetic field which penetrates the microwave junction zone; and a ferromagnetic resonator disposed in the microwave junction zone, the ferromagnetic resonator including a ferromagnetic body which extends over the entire height of the microwave junction zone and which has a plurality of bores with axes which are spaced-apart, the bores having cross sections that do not change in the direction of the static magnetic field, the number of bores in the microwave junction zone being substantially greater than the number of ports.

22. The junction circulator of claim 21, wherein the junction means comprises a pair of spaced-apart waveguide walls, the ferromagnetic body being disposed between the walls and contacting both walls, and wherein the walls have bores which communicate with the bores in the ferromagnetic body.

23. The junction circulator of claim 22, further comprising heat-conducting ceramic rods in the bores of the ferromagnetic body, the rods extending into the bores of the walls.

* * * * *